US006064841A

United States Patent [19]

Matsuzaki et al.

[11] Patent Number: 6,064,841

[45] Date of Patent: May 16, 2000

[54] POWER SUPPLY FOR A CHARGING APPARATUS HAVING A CONTACT CHARGER FOR CHARGING AN OBJECT TO BE CHARGED

[75] Inventors: Hiroomi Matsuzaki, Mishima; Tadayuki Tsuda; Katsunori Yokoyama, both of Susono, all of Japan

[73] Assignee: Canon Kabushiki Kaisha, Tokyo, Japan

[21] Appl. No.: 09/008,433

[22] Filed: Jan. 16, 1998

[30] Foreign Application Priority Data

Jan. 17, 1997 [JP] Japan ..... 9-019695

[51] Int. Cl.[7] ..... G03G 15/00; G03G 15/02

[52] U.S. Cl. ..... 399/90; 361/225; 399/176

[58] Field of Search ..... 399/90, 111, 115, 399/174, 176; 361/225

[56] References Cited

U.S. PATENT DOCUMENTS

| | | | |
|---|---|---|---|
| 5,367,364 | 11/1994 | Michlin et al. . | |
| 5,500,364 | 3/1996 | Yashiro et al. . | |
| 5,768,660 | 6/1998 | Kurihara et al. | 399/111 |
| 5,790,927 | 8/1998 | Ando et al. | 399/176 |
| 5,870,655 | 2/1999 | Nishiuwatoko et al. | 399/111 |
| 5,870,657 | 2/1999 | Nagame et al. | 399/174 |

FOREIGN PATENT DOCUMENTS 5-303263 11/1993 Japan .

OTHER PUBLICATIONS

European Search Report.

*Primary Examiner*—William J. Royer
*Attorney, Agent, or Firm*—Fitzpatrick, Cella, Harper & Scinto

[57] ABSTRACT

A charging apparatus includes a charging roller, contactable to an object to be charged, for charging the object to be charged, the charging roller being provided with a rotation shaft, an electroconductive bearing for supporting the rotation shaft, a contact member for urging the bearing to press-contact the charging roller to the object to be charged, wherein a first electric energy supply path is established from the contact member to the rotation shaft through the bearing to supply electric energy from the contact member to the rotation shaft, a power supply contacted to a peripheral surface of the rotation shaft, wherein the contact member urges the power supply to press-contact the power supply to the peripheral surface of the rotation shaft, wherein a second electric energy supply path is established to supply electric energy from the contact member to the rotation shaft through the power supply member, and the power supply member is movable in a direction of urging of the contact member independently of the bearing.

25 Claims, 6 Drawing Sheets

POWER SUPPLY FOR A CHARGING APPARATUS HAVING A CONTACT CHARGER FOR CHARGING AN OBJECT TO BE CHARGED

FIELD OF THE INVENTION AND RELATED ART

The present invention relates to a charging apparatus with a charging member for charging an object, wherein the charging member can be placed in contact with the object to be charged. The present invention also relates to a power supplying member for supplying the charging member with power.

There have been known various apparatuses as an apparatus for charging (inclusive of discharging) the surface of an image bearing member (object to be charged) such as an electrophotographic photosensitive member, an electrostatically recording dielectric member, or the like, in an image forming apparatus, for example, an electrophotographic apparatus (copying machine, laser beam printer, and the like), an electrostatic recording apparatus, or the like. Among those charging apparatuses, those which employ a so-called contact type charging system, in which an object to be charged is charged by placing a charging member in contact with the object to be charged, are preferred from the standpoint of reducing the power source voltage, the amount of ozone production, and power consumption. Among the contact type charging systems, a roller type charging system which employs a contact type charging member in the form of a roller (charging roller) is preferred from the standpoint of charge stability.

FIG. 9 shows the general structure of a contact type charging apparatus which employs a charge roller. In the drawing, a referential numeral 1 designates a charge roller, and a referential numeral 2 designates an object to be charged, for example, the rotary photosensitive drum of an image forming apparatus, with which the charge roller 1 is placed in contact.

The charge roller 1 comprises an electrically conductive metallic core 1*a* as a rotational axle, and an elastic layer 1*b* with adjusted resistance. The elastic layer 1*b* may comprise a single layer or may contain plural sub-layers coaxially layered on the peripheral surface of the electrically conductive metallic core 1*a*, with both end portions of the metallic core 1*a* being exposed from the elastic layer 1*b*. The charge roller 1 is rotatively held by a U-shaped bearing 9 which is placed at each end of the charge roller 1, with the open end of each U-shaped bearing 9 holding the correspondent end portion of the metallic core 1*a* exposed from the elastic layer 1*b*. Each bearing 9 is fitted in a vertical guide hole cut in the unillustrated side plate, to allow it to move toward, or away from, a photosensitive drum 2. Between each bearing 9 and an unillustrated member fixed above the bearing 9, a spring 10 (elastic member) is disposed to apply downward pressure to the bearing 9, so that the charge roller 1 is placed in contact with the peripheral surface of the photosensitive drum 2 with a predetermined contact pressure against the elasticity of the elastic layer 1*b* of the charge roller 1.

The photosensitive drum 2 is rotatively supported by bearings between the unillustrated side plates of the apparatus, and one end of the photosensitive drum 2 is fitted with a drum gear 2*a*, to which rotational force is transmitted from an unillustrated driving mechanism to rotatively drive the photosensitive drum 2 in a predetermined direction at a predetermined peripheral velocity (process speed). The charge roller 1 is rotated by the rotation of the photosensitive drum 2.

The bearing 9 located at each end of the charge roller 1 is formed of plastic material. The bearing 9 located on the side from which power is supplied to the charge roller 1 is rendered electrically conductive by dispersing carbon fiber in the plastic material when forming the bearing 9 on the power supplying side. The spring 10 on the electrically conductive bearing 9 side is disposed in the compressed state between the electrically conductive bearing 9 and an electrode plate 11 attached to the downward facing surface of the aforementioned unillustrated member fixed above the bearing 9. The spring 10 is electrically conductive. The electrode plate 11 is extended downward, and is bent at the end, forming an elastic contact point 11*a* which is placed elastically in contact with the end surface 1*g* of the metallic core 1*a* of the charge roller 1 on the side from which power is supplied to the charge roller 1. The electrode plate 11 is connected to a power source 13 for applying charge bias.

Thus, as a predetermined charge bias is applied to the electrode plate 11 from the power source 13 while the photosensitive drum 2 is rotatively driven with the charge roller 1 following the rotation of the photosensitive drum 2, the charge bias is applied to the charge roller 1 through the first power supply routes (a) as well as the second power supply route (b):

(a) electrode plate 11→electrically conductive spring 10→electrically conductive bearing 9→charge roller metallic core 1*a:*

(b) electrode plate 11→elastic contact point 11*a*→metallic core end surface 1*g* of charge roller 1→charge roller metallic core 1*a*.

When the charge roller 1 in the above described charging apparatus which is disposed in an image forming apparatus is not supplied with a proper amount of power, the photosensitive drum 2 as the object to be charged fails to be charged to the predetermined potential level, which effects an inferior image. Thus, two power supply routes, the first (a) and second (b), are provided as described above so that even if one of the routes fails to properly conduct the power, a proper amount of charge bias is applied to the charge roller 1 through the other route; in other words, power is reliably supplied to the charge roller 1.

In a charging apparatus with the above described structure based on the prior art, the elastic contact point 11*a* makes contact with the end surface 1*g* of the charge roller metallic core 1*a*. With this structure, while the apparatus is stored for an extended period of time, oxide film is liable to form between the contact surfaces of the elastic contact point 11*a* and the metallic core end surface 1*g* of the charge roller 1, along where they rub against each other, which increases the resistance at the contact between the two surfaces. As a result, the electrical conductivity at the contact is liable to become insufficient. In addition, the elastic electrode plate 11 is liable to be permanently deformed during the assembly of the components other than the elastic electrode plate 11 into the apparatus, and also, the contact pressure between the end surface 1*g* and the contact point 11*a* is liable to become unstable due to the movement of the charge roller 1 in its axial direction. As a result, the electrical conductivity between the elastic contact point 11*a* and the metallic core end surface 1*g* of the charge roller 1 is liable to become insufficient.

Further, the prior structure in which the contact point 11*a* of the elastic electrode plate 11 is placed elastically in contact with the metallic core end surface 1*g* of the charge roller 1 is liable to make odd noises when power is applied, and in order to prevent the occurrence of these odd noises, electrically conductive grease must be applied to the contact between the two components.

SUMMARY OF THE INVENTION

Thus, an object of the present invention is to improve the reliability and stability of the structure of the power supplying means, of a charging apparatus of the above described type, for supplying power to the rotary charging member of the charging apparatus, which is placed in contact with an object to charge the object.

Other objects of the present invention are to eliminate the need for applying electrically conductive grease which is for preventing the generation of the odd noises which are liable to occur while power is supplied to the charging member, and to prevent the contact pressure between the contact point of the contact electrode plate and the end surface of the metallic core of the charging member from becoming unstable due to the permanent deformation of the contact electrode plate which is liable to occur during the assembly of the components other than the electrode plate into the apparatus.

These and other objects, features and advantages of the present invention will become more apparent upon a consideration of the following description of the preferred embodiments of the present invention, taken in conjunction with the accompanying drawings.

BRIEF DESCRIPTION OF THE DRAWINGS

DETAILED DESCRIPTION OF THE PREFERRED EMBODIMENTS (1) Image Forming Apparatus FIG. 1 is a schematic section of an example of an image forming apparatus which employs a charging apparatus in accordance with the present invention, and depicts the general structure thereof. The image forming apparatus in this drawing is a laser beam printer, and employs a replaceable process cartridge based on a transfer type electrophotographic system.

Figure 1:
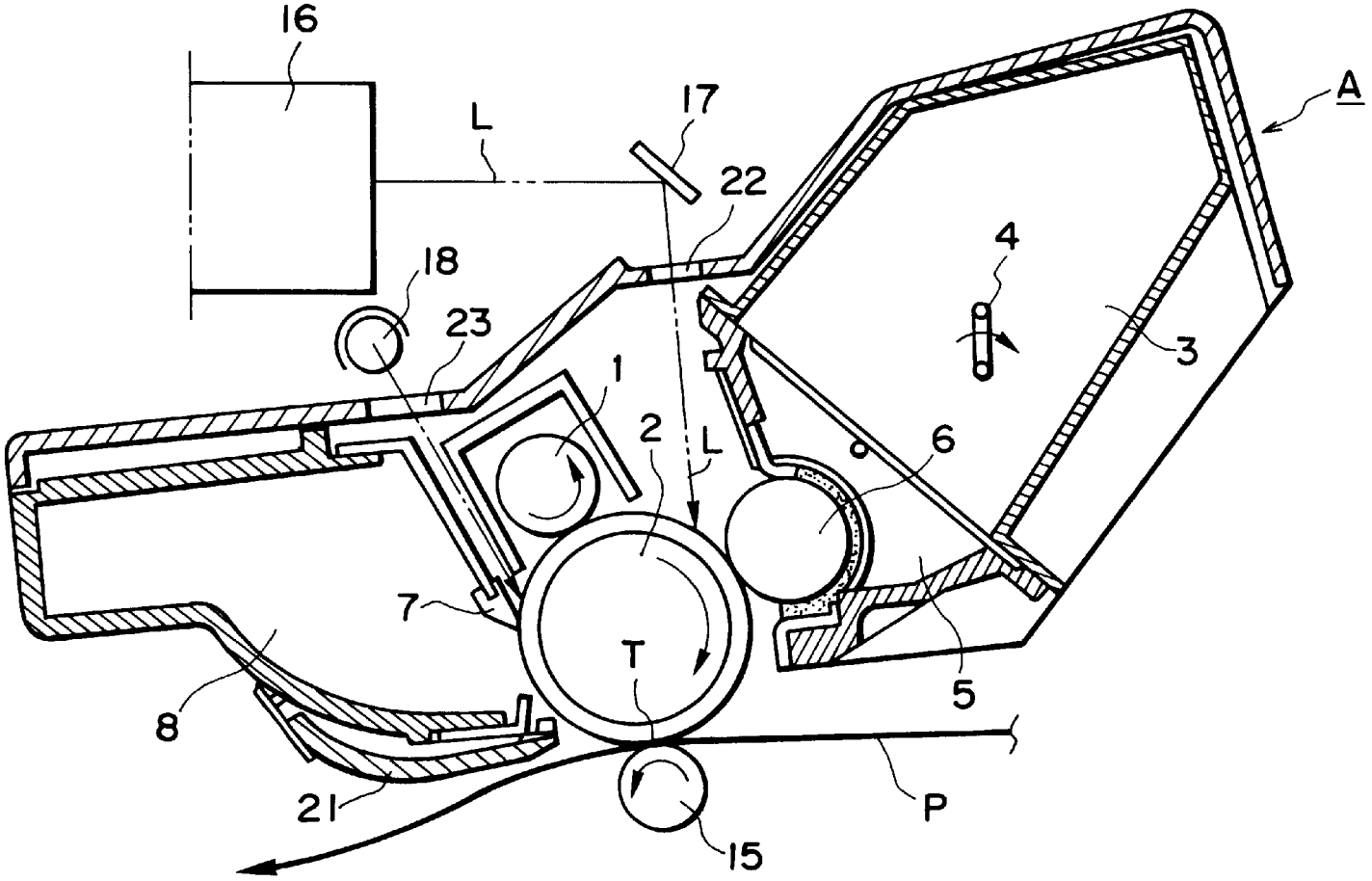
FIG. 1 is a schematic section of an image forming apparatus in the first embodiment of the present invention.

In the drawing, a referential character A designates a process cartridge removably installable at a predetermined location in the main assembly of the image forming apparatus. The process cartridge A comprises four processing devices: an electrophotographic, photosensitive rotary drum 2 as an image bearing member, a rotary charge roller 1 as a charging member for charging the photosensitive drum 2, a developing device 5, and a cleaning device 8, which are integrally disposed in the cartridge shell, holding a predetermined positional relationship among them. It should be noted here that a process cartridge has only to have an image bearing member, and at least one processing apparatus among the charging member, developing device, and cleaning device.

As the process cartridge A is placed at the predetermined location in the main assembly of the printer, the process cartridge A and the main assembly of the printer make predetermined mechanical and electrical connections, readying the printer for image formation.

A referential numeral 21 designates a drum cover. It is attached to the underside of the process cartridge, and covers the bottom side of the photosensitive drum 2 to protect the photosensitive drum 2 when the process cartridge A is out of the main assembly of the printer. It is moved to the position illustrated in FIG. 1 to expose the bottom side of the photosensitive drum 2 as the process cartridge A is installed into the main assembly of the printer. When the process cartridge A is at the predetermined location in the main assembly of the printer, the exposed bottom portion of the photosensitive drum 2 is placed in contact with a transfer roller 15, as a transferring means, on the printer main assembly side, with a predetermined contact pressure, and forms a transfer nip T.

Referential numerals 16 and 17 designate a laser scanner and a laser beam deflection mirror, respectively, on the printer main assembly side. A referential numeral 18 designates a discharger lamp (eraser lamp), which also is on the printer main assembly side.

In response to a print start signal, the photosensitive drum 2 is rotatively driven at a predetermined peripheral velocity in the clockwise direction indicated by an arrow mark. Since the charge roller 1 is in contact with the photosensitive drum 2 with the predetermined contact pressure, it is rotated by the rotation of the photosensitive drum 2.

To the charge roller 1, a predetermined charge bias is applied from an unillustrated charge bias power source. As a result, the peripheral surface of the photosensitive drum 2 is uniformly charged to a predetermined polarity and a predetermined potential level (primary charge); the peripheral surface of the photosensitive drum 2 is charged using the contact type charging system.

Next, a laser beam L modulated with the image signals originating from a target image is projected from the laser scanner 16. The laser beam L is deflected by mirror 17 and enters the main assembly of the process cartridge through a first exposure window 22 of the main assembly of the process cartridge, scanning the peripheral surface of the photosensitive drum 2, which has been charged by the charge roller 1. As a result, an electrostatic latent image of the target image is formed on the peripheral surface of the photosensitive drum 2.

Next, the electrostatic latent image on the peripheral surface of the rotary photosensitive drum 2 is reversely developed into a toner image by the developing device 5 (toner is adhered to the exposed areas of the peripheral surface of the photosensitive drum 2 by the amount proportional to the amount of exposure). In the developing device 5, referential numerals 6 and 3 designate a development sleeve and a toner container, respectively, and a referential numeral 4 designates a stirring means for stirring the toner in the toner container 3 and also for moving the toner to the development sleeve.

The toner image on the photosensitive rotary drum 2 is transferred, in the transfer nip T, onto a transfer medium P delivered to the transfer nip T from the unillustrated sheet feeding portion of the printer main assembly with predetermined timing. The transfer of the toner image onto the transfer medium P is electrostatically caused as a predetermined transfer bias is applied to the transfer roller 15 from the unillustrated transfer bias power source.

After receiving the toner image while passing through the transfer nip T, the transfer medium P is separated from the peripheral surface of the photosensitive rotary drum 2, and then is introduced into an unillustrated fixing device, in which the toner image is permanently fixed to the transfer medium P. Thereafter, the transfer medium P with the fixed toner image is outputted as a finished print from the image forming apparatus.

After the separation of the transfer medium P, the peripheral surface of the photosensitive rotary drum 2 is cleaned by the cleaning device 8; the toner particles remaining on the peripheral surface of the photosensitive rotary drum 2 are scraped away by the cleaning blade 7 of the cleaning device 8. Then, while between the cleaning blade and the charge roller 1, the cleaned peripheral surface of the photosensitive rotary drum 2 is entirely exposed, to the light from the discharger lamp 18 on the printer main assembly side, which is projected into the process cartridge main assembly through a second exposure window 23 of the process cartridge main assembly. As a result, the electrical memory is removed from the photosensitive rotary drum 2, and the photosensitive rotary drum 2 is used for the following image forming process.

(2) Charging apparatus

Figure 2:
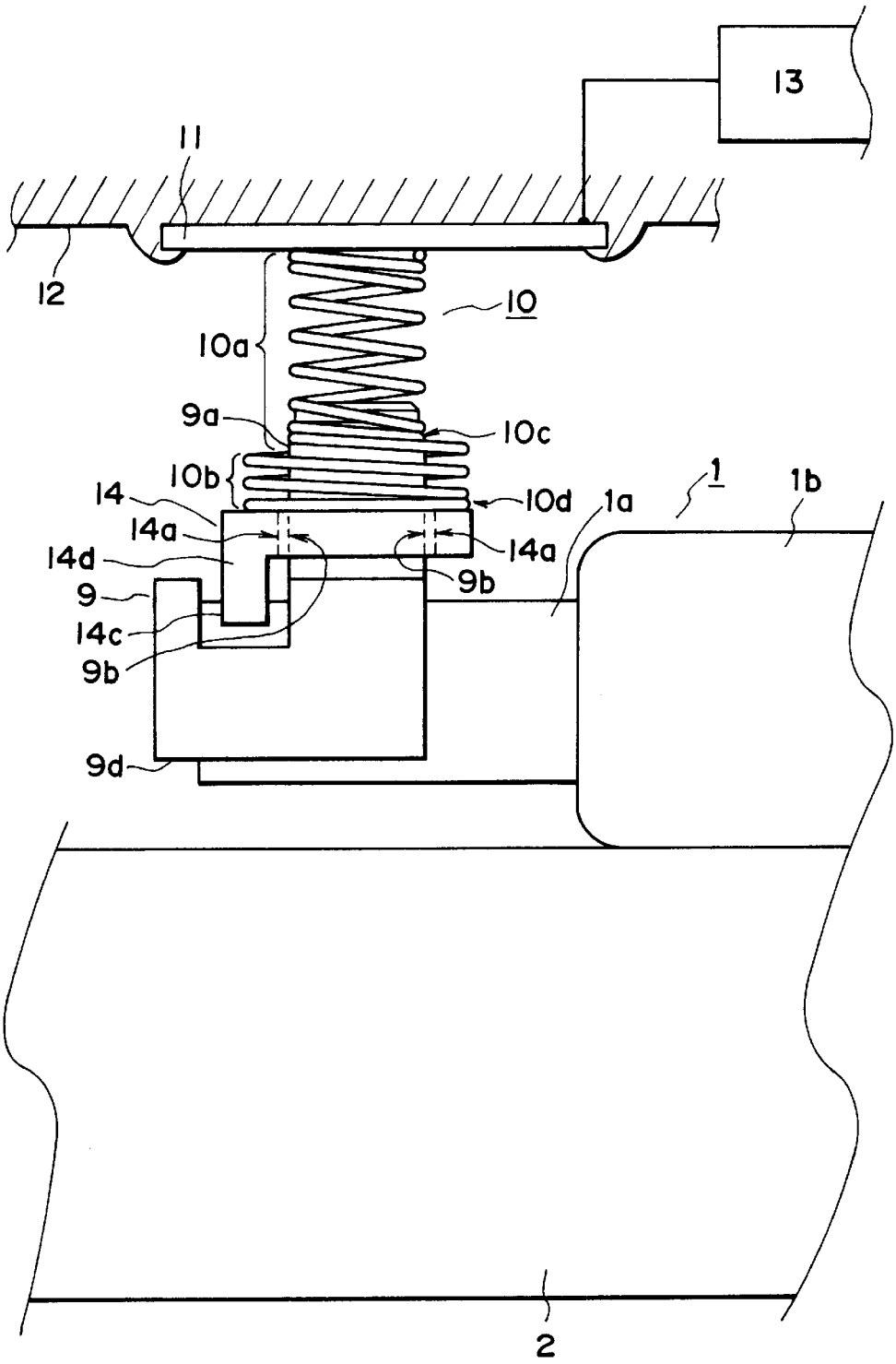
FIG. 2 is a side view of a power supplying portion of a charging apparatus in the first embodiment.
Figure 3:
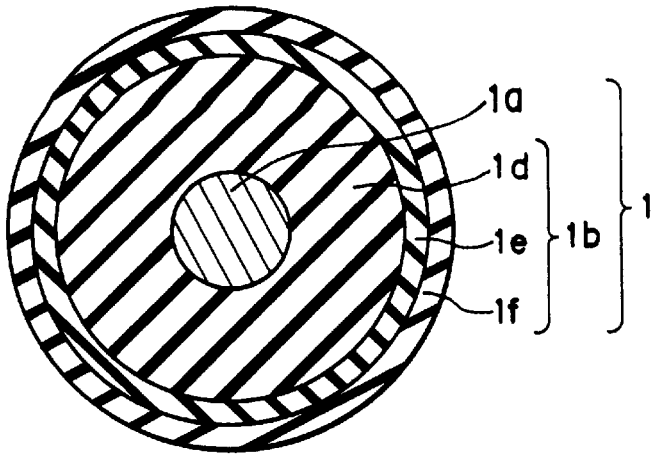
FIG. 3 is a schematic section of a charge roller.
Figure 4:
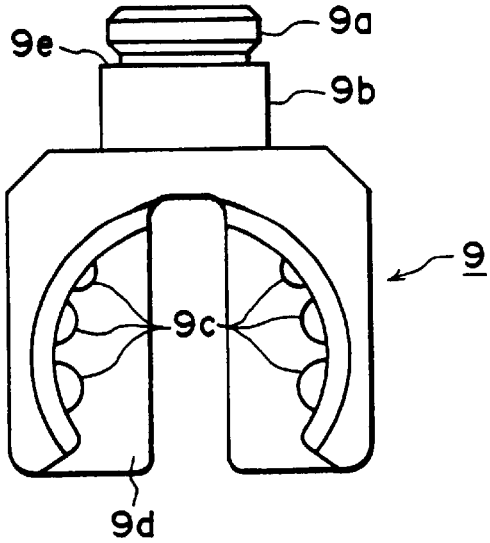
FIG. 4 is a side view of a first power supplying member.
Figure 5:
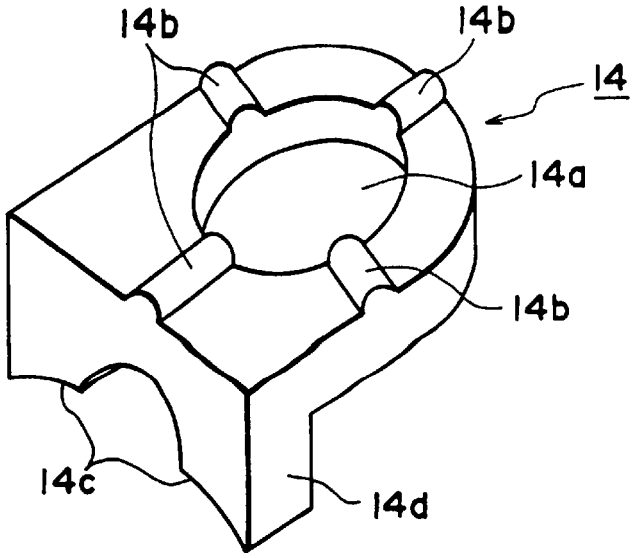
FIG. 5 is an external perspective view of a second power supplying member.

FIG. 2 is a side view of the contact type charge apparatus which employs a charging roller such as the one described above, and depicts the general structure of the charging apparatus. FIG. 3 is a schematic section of the charge roller, and depicts the 1*a* laminar structure thereof. FIG. 4 is an external view of a first power supplying member, and FIG. 5 is an external perspective view of a second power supply member.

The charge roller 1 in this embodiment is a contact type charging member. It comprises an electrically conductive metallic core 1*a* as a rotational shaft, and an elastic layer 1*b* concentrically layered around the peripheral surface of the metallic core 1*a*. The elastic layer 1*b* is constituted of a plurality of sub-layers: an electrically conductive elastic base layer 1*d*, a high resistance elastic layer 1*e* laid on the elastic layer 1*d*, and an outermost protective layer 1*f* laid on the high resistance elastic layer 1*e*. The volumetric resistivity of the high resistance elastic layer 1*e* is greater than that of the electrically conductive elastic layer 1*d*. The electrically conductive elastic layer 1*d* functions to conduct the bias voltage supplied to the metallic core 1*a*. The high resistance elastic layer 1*e* functions to control the current leak to the photosensitive drum 2 to prevent the bias voltage from suddenly dropping even when the charge roller 1, which is relatively highly conductive, encounters a pin hole or the like on the peripheral surface of the photosensitive drum 2. The outermost protective layer If functions to prevent the compositional materials of the elastic layer 1*d* or the high resistance elastic layer 1*e* from coming in contact with the peripheral surface of the photosensitive drum 2 and denaturing it.

The charge roller 1 is rotatively supported by the bearings 9, with each end of the metallic core 1*a*, which penetrates the center of the charge roller 1, being fitted in the bearing 9. Each bearing 9 is fitted in its own vertical guide hole, with which the cartridge main assembly is provided. Therefore, it is allowed to come into contact with, or move away from, the photosensitive drum 2. Above each bearing 9, an immobile member 12 formed of electrically insulative resin is fixed to the cartridge main assembly, and between each bearing 9 and the immobile member 12, a coil spring 10 (elastic member) is disposed in the compressed state so that the coil spring 10 presses the bearing 9 in the direction of the photosensitive drum 2 (downward). As a result, the elastic layer 1*b* of the charge roller 1 is pressed against the peripheral surface of the photosensitive drum 2, generating a predetermined contact pressure due to the elasticity of the elastic layer 1*b*.

The charge roller 1 is not provided with means for directly driving the charge roller 1, and is driven by the rotation of the photosensitive drum 2.

An electrode 11, which is formed of metallic plate, is fixed to the bottom surface of the aforementioned immobile member 12. It is disposed on only one side of the longitudinal ends of the charge roller 1. As the cartridge is installed on the predetermined location in the printer main assembly, the electrical power source 13 on the printer main assembly side and the electrode 11 are electrically linked.

The coil spring 10 is a two-stage compound spring, being constituted of the first and second sections 10*a* and 10*b*. Two sections 10*a* and 10*b* are concentric, and the second section 1*b* is larger in diameter than the first section. The end portion 10*c* of the first section of the compound spring 10 is fitted around a boss 9*a* located on top of the bearing 9, and presses the bearing 9 with the pressure from the first section 10*a* of the spring 10. The top end portion of the boss 9*a* of the bearing 9 is provided with a spring seat 9*e* (FIG. 4), which is in contact with the end portion 10*c* of the first section 10*a* and bears the pressure from the section 10*a*. The end portion 10*c* of the first section 10*c* comprises at least one full turn of the spring so that the pressure from the first section 10*a* of the spring 10 is squarely borne by the spring seat 9*e* of the bearing 9.

The bearing 9 is given electrical conductivity by dispersing carbon fiber in the bearing material when the bearing 9 is formed, and constitutes a part (first power supplying member) of the first power transmission path for charge bias to the charge roller 1. With this arrangement, the charge roller 1 is pressed against the bearing 9 with a pressure of 400 g–1,000 g generated by the section 10*a* of the spring 10, and therefore, the bearing 9 is required to have both electrical conductivity and lubricity, across its bearing surface, that is, the surface which remains in contact with the metallic core 1*a* of the charge roller 1. Thus, as for the material for the bearing 9, composite material composed by dispersing carbon fiber as electrically conductive particles in base resin, for example, polyacetal, by 10%–30% in weight, is desirable.

Also, the spring 10 is rendered electrically conductive. With this arrangement, the electrode 11 and the metallic core 1*a* are electrically linked through the spring 10 and the bearing 9. Further, the inward facing surface, that is, the actual bearing surface, of the bearing 9 is provided with a plurality of bulges 9*c* to promote carbon fiber to collect in the adjacencies thereof, and therefore, the metallic core 1*a* of the charge roller 1 slides on these bulges, improving reliability in terms of electrical conductivity. Further, the bearing 9 is provided with a thrust bumper 9*d* for the thrust from the charge roller 1 to regulate the movement (thrust) of the charge roller 1 in the axial direction.

The base portion 9*b* of the boss 9*a* of the bearing 9 is fitted in the hole 14*a* of a contact member (second contact member) 14. The hole 14*a* of the contact member 14 is rendered greater in diameter than the base portion 9*b* of the boss 9*a* of the bearing 9 so that the contact member 14 is allowed to slide on the peripheral surface of the base portion 9*b* of the boss 9*a* of the bearing 9 in the direction in which the spring 10 is compressed or allowed to expand. The transitional point of the coil spring 10, at which the first section 10*a* turns into the second section 10*b*, is fixed to the top portion of the boss 9*a* of the bearing 9. The second section 10*b* of the spring 10 is disposed in the compressed state between this top portion of the boss 9*a* and the top surface (pressure bearing surface) of the contact member 14, pressing thereby the contact portion 14*c* of the contact member 14 onto the peripheral surface of the metallic core 1*a*. The top surface (pressure bearing surface) of the contact member 14 is provided with a plurality of bulges 14*b*, promoting the collection of carbon fiber. With this arrangement in which the bulges 14*b* of the contact member 14 and the bottom end portion 10*d* of the second section 10*b* of the spring 10 make contact with each other, reliability is improved in terms of electrical conductivity.

It should be noted here that the contact member 14 is different from the bearing 9 in that the former does not support the metallic core 1*a*, and is nothing but a contact member. Therefore, it is desirable from the standpoint of durability that the pressure applied to the contact member 14 is just enough for the contact member to play its role. In this embodiment, a low pressure of 50 gf–200 gf is applied. Thus, electrically conductive composite material composed by dispersing carbon fiber in base resin, for example, polyphenylene sulfide capable of containing a relatively large amount of carbon fiber, by 30–40% in weight is desirable as the material for the contact member 14. The electrical resistances of the bearing 9 and the contact member 14 are adjusted to be no more than 5 kΩ.

Figure 6:
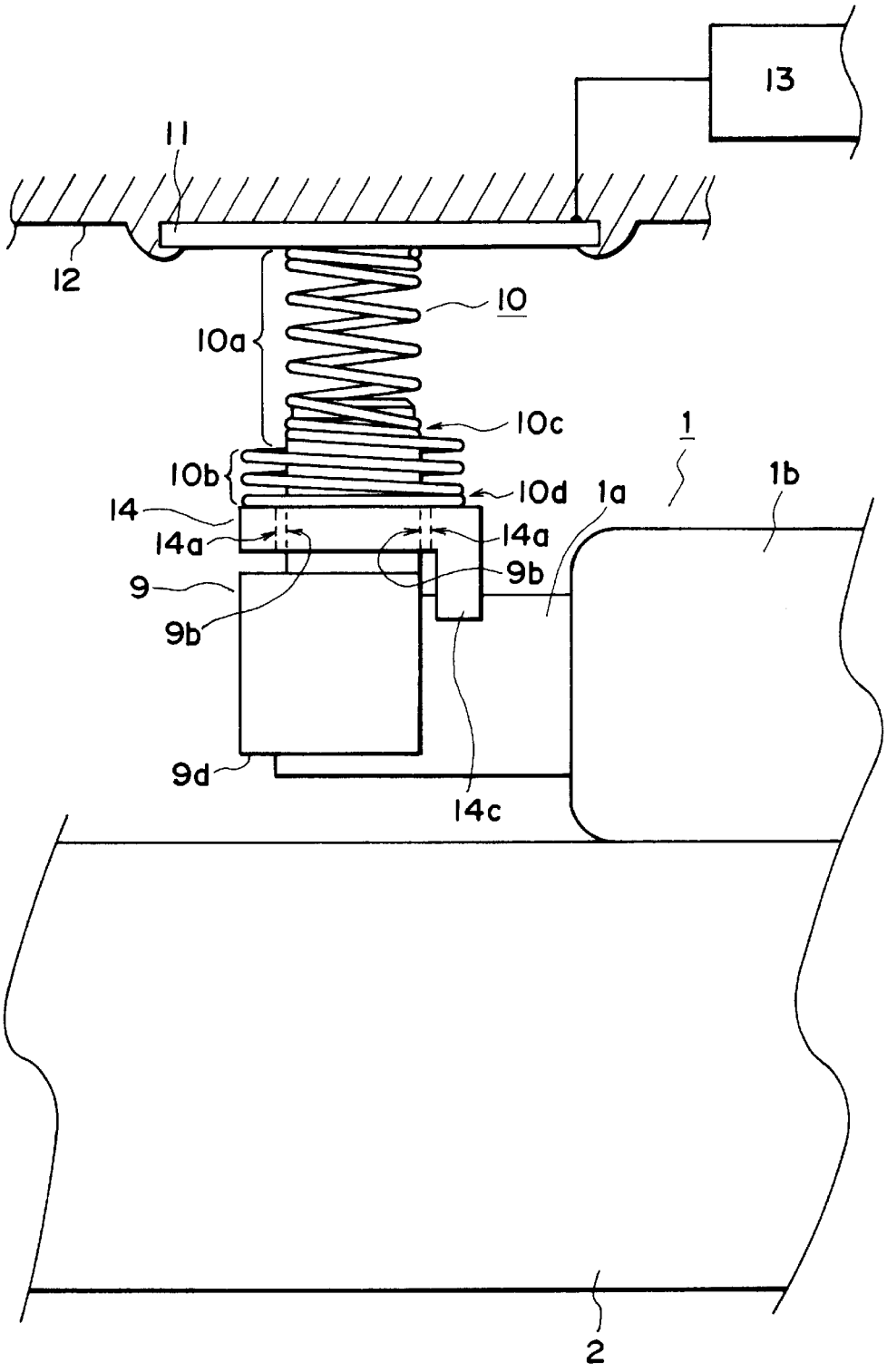
FIG. 6 is a side view of a power supplying portion of a charging apparatus, which is different from the power supplying portion illustrated in FIG. 2.

The contact member 14 has an extended portion 14*d* which extends from the pressure bearing main section in the direction in which the spring 10 is compressed or allowed to expand, that is, the direction perpendicular to the pressure bearing section of the contact member 14, and this extended portion 14*d* of the contact member 14 has two contact portions 14*c* which make contact with the metallic core 1*a*, straddling the metallic core 1*a* across it axial line, and thereby making contact with the metallic core 1*a* at two locations, one on each side of the longitudinal center line of the spring 10, as illustrated in FIG. 5. This arrangement is made for the following reason. That is, the positioning of the bearing 9 is mainly affected by the position of the longitudinal ends of the cleaning blade, and therefore, a power supplying portion employing this arrangement can be used in process cartridges of different types; for example, the power supplying portion illustrated in FIG. 6, in which the dimension of the bearing 9 is shortened in the axial direction of the charge roller 1 to cause the contact portions 14*c* to make contact with the metallic core 1*a* on the inward side of the spring 10 relative to the longitudinal direction of the charge roller 1. In other words, this arrangement has a merit in that it makes the same components usable in different apparatuses, reducing thereby the apparatus cost due to the benefit from the mass production of the same components.

The end portion 10*d* of the second section 10*b* of the spring 10, which contacts the contact member 14, is constituted of at least one full turn of the spring. This is because the contact member 14 has two contact portions 14*c*, straddling the axial line of the metallic core 1*a*, or one contact portion 14*c* on each side of the longitudinal center line of the spring 10, and therefore, the pressure applied to one contact portion 14*c* becomes different from that applied to the other contact portion 14*c* depending on where the end of the coil spring is located, unless the end portion 10*d* is constituted of at least one full turn of the spring.

Thus, as a predetermined charge bias is applied to the electrode 11 from the power source 13 while the photosensitive drum 2 is rotatively driven, with the charge roller 1 following the rotation of the photosensitive drum 2, the charge bias is applied to the charge roller 1 through the first power supply route (a) as well as the second power supply route (b):

(a) electrode 11→first section 10*a* of the spring 10→electrically conductive bearing 9→metallic core 1*a* of charge roller 1:

(b) electrode 11 →first section 10*a* of spring 10→second section 10*b* of spring 10→contact member 14→metallic core 1*a* of charge roller 1.

Therefore, even if power transmission through one of the two power supplying routes becomes difficult, the charge bias is applied by the predetermined amount through the other power supplying route, and consequently, the photosensitive drum 2 is properly charged as if there were no difficulty in terms of power transmission.

Figure 9:
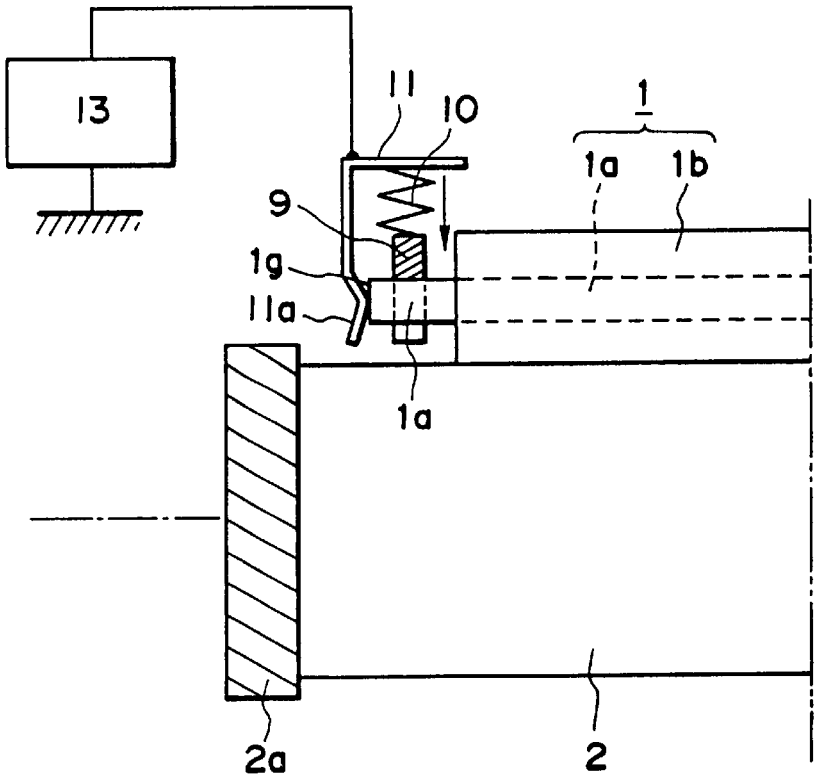
FIG. 9 PRIOR ART
FIG. 9 is a side view of the essential portion of a charging apparatus based on the prior art.

The power supplying portion in this embodiment is different from the power supplying portion based on the prior art, particularly in that the second power supplying route is structured so that the power is supplied to the charge roller 1 by placing the contact member 14 in contact with the peripheral surface of the metallic core 1*a*, with the use of the second section 10*b* of the electrically conductive coil spring 10, whereas in the case of the power supplying portion based on the prior art, the power is supplied to the charge roller 1 by placing the elastic contact point 11*a* of electrode 11 elastically in contact with the end surface 1*g* of the metallic core of the charge roller 1 (FIG. 9). Therefore, in the case of the power supplying portion in this embodiment, the power transmission failure related to the oxide film formed when a cartridge employing the power supplying portion based on the prior art is stored for an extended period of time or during the like period, the odd noises which occur when power is supplied to the charge roller 1 through the power supplying portion based on the prior art, and the permanent deformation of the electrode which occurs to the power supplying portion based on the prior art during the assembly of the components other than those for the power supplying portion, do not occur, and obviously, it is unnecessary to apply electrically conductive grease to the contact area since the odd noises are not generated.

Further, in this embodiment, power is not supplied through the end surface of the metallic core 1*a* of the charge roller 1, and therefore, the dimension of the power supplying portion in the longitudinal direction of the charge roller 1 can be reduced, contributing to the size reduction for the cartridge A.

Thus, in an image forming apparatus or a process cartridge which employs the charging apparatus described in the first embodiment of the present invention, the image bearing member as the object to be charged is desirably charged, effectively preventing the occurrence of image defects related to insufficient charge.

Embodiment 2

Figure 7:
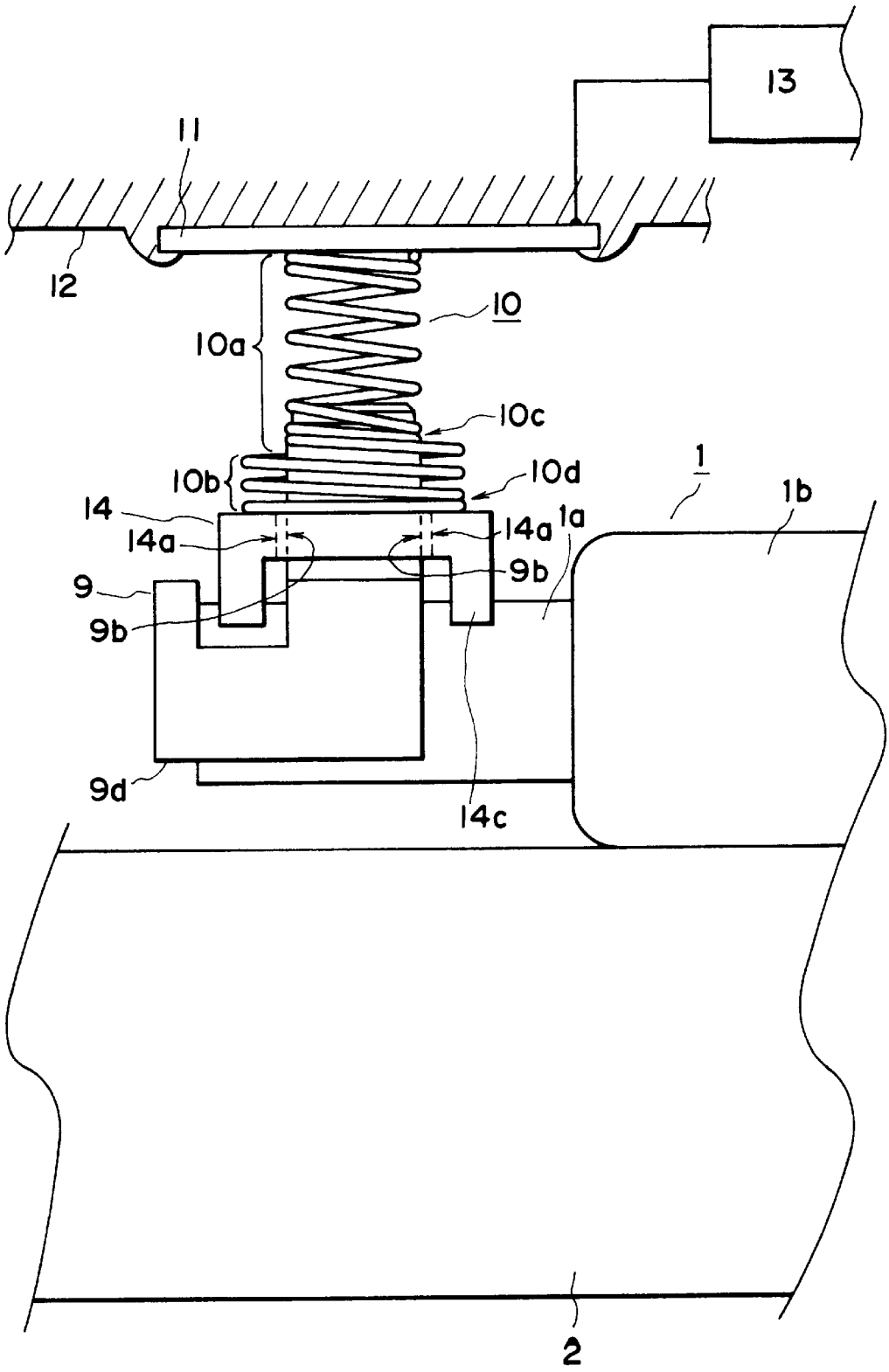
FIG. 7 is a side view of a charging apparatus in the second embodiment.
Figure 8:
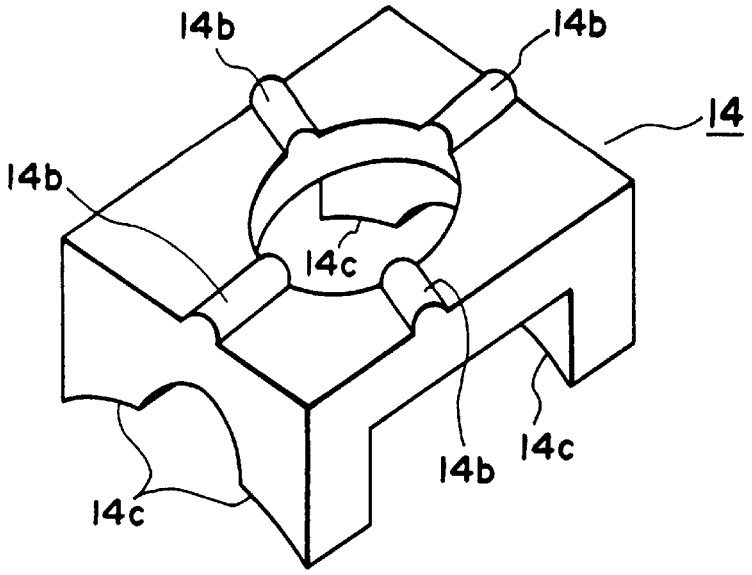
FIG. 8 is an external perspective view of a second power supplying member in the second embodiment of the present invention.

FIG. 7 is a side view of the power supplying portion in the second embodiment of the present invention, and depicts the power supplying route of the charging apparatus. FIG. 8 is an external perspective view of the contact member 14 illustrated in FIG. 7. This embodiment is substantially the same as the preceding one except for the shape of the contact member 14.

In this embodiment, the contact member 14 is provided with four contact portions 14*c* which actually make contact with the charge roller 1, and these four contact portions 14*c* are symmetrical about the longitudinal center line of the coil spring 10. With this arrangement, the pressure from the second section 10*b* of the spring 10 is evenly distributed across the contact member 14, being thereby more effectively utilized than in the preceding embodiment. Further, increasing the number of the contact portions 14*c* increases the overall contact area between the contact member 14 and the charge roller 1, enabling power to be more reliably supplied than in the preceding embodiment.

As described above, according to the present invention, power is supplied to the charge roller 1 through the peripheral surface of the metallic core 1*a* of the charge roller 1. Therefore, the power supplying route through the end surface of the metallic core 1*a* can be eliminated. Consequently, the structure of the power supplying portion can be simplified, and also, the space for the power supplying portion can be reduced. Further, regarding the surface of the metallic core 1*a*, on which the contact point or portions of the contact member slide, it is easier to process the peripheral surface of the metallic core 1*a* than the longitudinal end thereof, and the number of steps necessary to process the peripheral surface of the metallic core 1*a* is smaller than the number of steps necessary to process the longitudinal end of the metallic core 1*a*. Therefore, the power supplying portion in accordance with the present invention can reduce the production cost. In addition, in the case of the power supplying portion structure based on the prior art, there is a concern that the contact pressure between the contact member and the metallic core 1*a* is susceptible to the thrust of the charging member, whereas in the case of the power supplying portion structure in accordance with the present invention, in which the contact portions slide on the peripheral surface of the metallic core, the contact pressure between the contact member and the metallic core is stable. In other words, according to the present invention, the charge roller is supplied with stable power.

While the invention has been described with reference to the structures disclosed herein, it is not confined to the details set forth and this application is intended to cover such modifications or changes as may come within the purposes of the improvements or the scope of the following claims.

What is claimed is:

1. A charging apparatus for charging an object to be charged, comprising:

a charging roller, having an electroconductive rotation shaft;

an electroconductive bearing for bearing said rotation shaft;

an electric contact member 1 contacted to a peripheral surface of said rotation shaft, for supplying electric energy to said rotation shaft;

a coil spring for pressing both of said bearing and said electric contact member to said rotation shaft to supply the electric energy both to said bearing and said electric contact member;

wherein said coil spring includes a first spring section contacting to said bearing and a second spring section having a diameter different from that of said first spring section and contacted to said electric contact member.

2. An apparatus according to claim 1, further comprising an electrode for receiving voltage from a voltage source, wherein said electrode is electrically connected with said coil spring.

3. An apparatus according to claim 1, wherein said first spring section has the outer diameter which is smaller than that of said second spring section.

4. An apparatus according to claim 1, wherein said coil spring urges said bearing with force which is larger than force with which said coil spring urges said electric contact member.

5. An apparatus according to claim 1, wherein said first spring section urges said bearing with force of 400 gf–1000 gf, and said second spring section urges said electric contact member with force of 50 gf–200 gf.

6. An apparatus according to claim 1, wherein an end of said first spring section contacted to said bearing has at least one turn of coil.

7. An apparatus according to claim 1, wherein said bearing is provided with a boss portion for press-fitting of said first spring section.

8. An apparatus according to claim 7, wherein said electric contact member is provided with a hole through which said boss portion is penetrated.

9. An apparatus according to claim 1, wherein said electric contact member is provided with a cut-away portion to avoid interference with said bearing.

10. An apparatus according to claim 1, wherein said electric contact member is provided with a hole through which said bearing is penetrated.

11. An apparatus according to claim 1, wherein said bearing comprises resin material in which electroconductive particles are dispersed.

12. An apparatus according to claim 1, wherein said bearing comprises polyacetal resin material in which carbon fibers are dispersed.

13. An apparatus according to claim 1, wherein said electric contact member comprises resin material in which electroconductive particles are dispersed.

14. An apparatus according to claim 1, wherein said electric contact member comprises polyphenylenesulfide resin material in which carbon fiber is dispersed.

15. An apparatus according to claim 1, wherein said electric contact member is provided with a plurality of projections contacted to the peripheral surface of said rotation shaft.

16. An apparatus according to claim 1, wherein said bearing is provided with a plurality of projections for rotatably supporting said rotation shaft.

17. An apparatus according to claim 1, wherein said bearing is provided with a regulating portion for regulating movement of said rotation shaft in a longitudinal direction of said rotation shaft by contact with a longitudinal end surface of said rotation shaft.

18. An apparatus according to claim 1, wherein said charging roller is in the form of a roller.

19. An apparatus according to any one of claims 1, 2 and 4–16 and 18, wherein said charging apparatus is provided in a process cartridge which is detachably mountable relative to an image forming apparatus, and wherein said process cartridge is provided with an image bearing member to be charged by said charging apparatus.

20. An electric energy supply member for supplying electric energy to a rotation shaft of a charging roller contactable to an object to be charged to charge the object to be charged, said electric energy supply member comprising:

a member to be urged by an elastic member to press-contact said electric energy supply member to a peripheral surface of said rotation shaft;

an extension extending in a direction crossing with said member to be urged, said extension being provided with a contact portion for contacting to the peripheral surface of said rotation shaft;

a cut-away portion for avoiding interference with a projection of bearing member for supporting said rotation shaft, said projection being engageable with said elastic member.

21. An electric energy supply member according to claim 20, wherein said cut-away portion is in the form of a hole permitting penetration of said projection.

22. An electric energy supply member according to claim 20, wherein said electric energy supply member comprises resin material in which electroconductive particles are dispersed.

23. An electric energy supply member according to claim 20, wherein said electric energy supply member comprises polyphenylenesulfide resin material in which carbon fiber is dispersed.

24. An electric energy supply member according to claim 20, wherein said electric energy supply member is provided with a plurality of projections contacted to the peripheral surface of said rotation shaft.

25. An electric energy supply member according to claim 20, wherein said electric energy supply member is provided with a plurality of projections contacted to said elastic member.

* * * * *

UNITED STATES PATENT AND TRADEMARK OFFICE

CERTIFICATE OF CORRECTION

PATENT NO. : 6,064,841
DATED : May 16, 2000
INVENTOR(S) : Hiroomi Matsuzaki, et al.

It is certified that error appears in the above-identified patent and that said Letters Patent is hereby corrected as shown below:

Title page,
Under item [56] References Cited, U.S. Patent Documents,
"5,500,364, 3/1996 Yashiro et al." should read
-- 5,500,714 3/1996 Yashiro et al. --

Column 5,
Line 32, "la laminar" should read -- laminar --.

Column 9,
Line 49, "member 1" should read -- member --.

Column 10,
Line 54, "claims 1, 2 and" should read -- Claims 1-18, --;
Line 55, "4-16 and 18," should be deleted.

Signed and Sealed this

Eleventh Day of September, 2001

*Attest:*

Nicholas P. Godici

*Attesting Officer*

NICHOLAS P. GODICI
*Acting Director of the United States Patent and Trademark Office*